US006341816B1

(12) United States Patent
Chen et al.

(10) Patent No.: US 6,341,816 B1
(45) Date of Patent: Jan. 29, 2002

(54) COLLAPSIBLE ROCKING CHAIR

(75) Inventors: Er-Jui Chen, Feng-Shan; Chuan-Tso Tai, Chia-I Hsien, both of (TW)

(73) Assignee: Link Treasure Limited, Tortola (VG)

( * ) Notice: Subject to any disclaimer, the term of this patent is extended or adjusted under 35 U.S.C. 154(b) by 0 days.

(21) Appl. No.: 09/650,461

(22) Filed: Aug. 28, 2000

(30) Foreign Application Priority Data

Mar. 31, 2000 (TW) ..... 89205201 U

(51) Int. Cl.[7] ..... A47D 1/02
(52) U.S. Cl. ..... 297/16.1; 297/DIG. 11
(58) Field of Search ..... 297/16.1, 440.15, 297/DIG. 11, 440.16, 440.11, 451.3

(56) References Cited

U.S. PATENT DOCUMENTS 4,553,786 A * 11/1985 Lochett, III et al. . 297/DIG. 11 X
5,207,478 A * 5/1993 Freese et al. ..... 297/16.1
5,269,591 A * 12/1993 Miga, Jr. et al. ..... 297/16.1 X
5,460,430 A * 10/1995 Miga, Jr. et al. . 297/DIG. 11 X
5,503,458 A * 4/1996 Petrie ..... 297/16.1 X
5,507,564 A * 4/1996 Huang ..... 297/DIG. 11 X

* cited by examiner

*Primary Examiner*—Peter R. Brown
(74) *Attorney, Agent, or Firm*—W. Wayne Liauh

(57) ABSTRACT

A collapsible rocking chair is collapsed from an unfolded position to a folded position. The rocking chair comprises an upper frame, a lower frame and a seat frame that pivotally mounted by pair of latches. In the unfolded position rocking chair is adapted for children to sit or lie thereon. Upper frame lower frame and seat are collapsed to a compact storage position by pivoting about latches when rocking chair is not in use.

13 Claims, 10 Drawing Sheets

COLLAPSIBLE ROCKING CHAIR

BACKGROUND OF THE INVENTION

1. Field of Invention

The present invention relates to the art of rocking chair and more particularly to a collapsible rocking chair intended for children.

2. Related Art

Conventionally, rocking chairs for children are classified as rocker supported rocking chairs and spring supported rocking chairs. A rocker supported rocking chair has a curved member on the bottom for allowing a rocking movement. As to spring supported rocking chairs, a number of prior art disclose such rocking chairs e.g., U.S. Pat. Nos. 4,553,768, 5,187,826, 5,269,591 and 5,503.458. Generally speaking, a spring supported rocking chair comprises a bottom frame, a seat frame and a back frame. The bottom frame disposes on the ground and a back frame connects to the bottom frame. The fabric covers on seat frame and back frame. Back frame keeps an angle or a distance with the bottom frame such that children seated or recumbent on the chair may rock up and down.

However, the previous designs suffered from a disadvantage. That is bottom frame. seat frame and back frame are affixed one another. It is understood that a considerable receiving space is required for such rocking chair when it is not in use. There is an improved detachable rocking chair available now. But it is unsatisfactory for the purpose for which the invention is concerned because the assembly and disassembly thereof are tedious.

Thus, it is desirable to provide a novel collapsible rocking chair in order to overcome the above drawbacks of prior art.

SUMMARY OF THE INVENTION

It is therefore an object of the present invention to provide a collapsible rocking chair. The collapsible rocking chair is collapsed to a compact storage position when it is not in use.

The collapsible rocking chair of the present invention is collapsed from an unfolded position for children to use to a folded position for storage. This collapsible rocking chair comprising an upper frame, a lower frame and a seat frame that pivotally mounted by pair of latches. In the unfolded position, rocking chair is adapted for children to sit or lie thereon. Upper frame, lower frame and seat are collapsed to a compact storage position by pivoting about latches when rocking chair is not in use.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become fully understood from the detailed description given hereinbelow illustration only, and thus are not limitative of the present invention, and wherein.

DETAILED DESCRIPTION OF THE INVENTION

Figure 1:
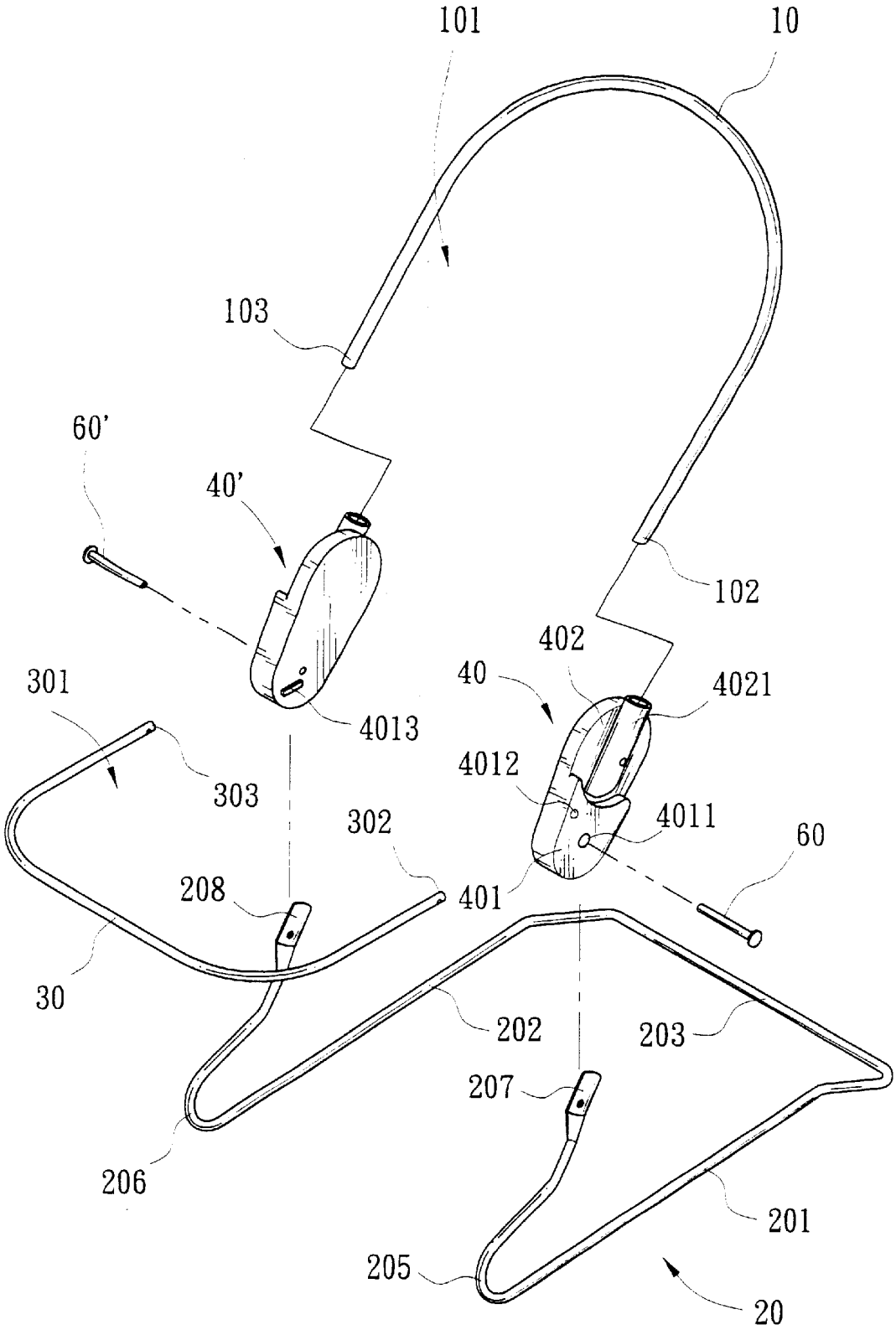
FIG. 1 is an exploded view of a first preferred embodiment of collapsible rocking chair according to the invention.
Figure 2:
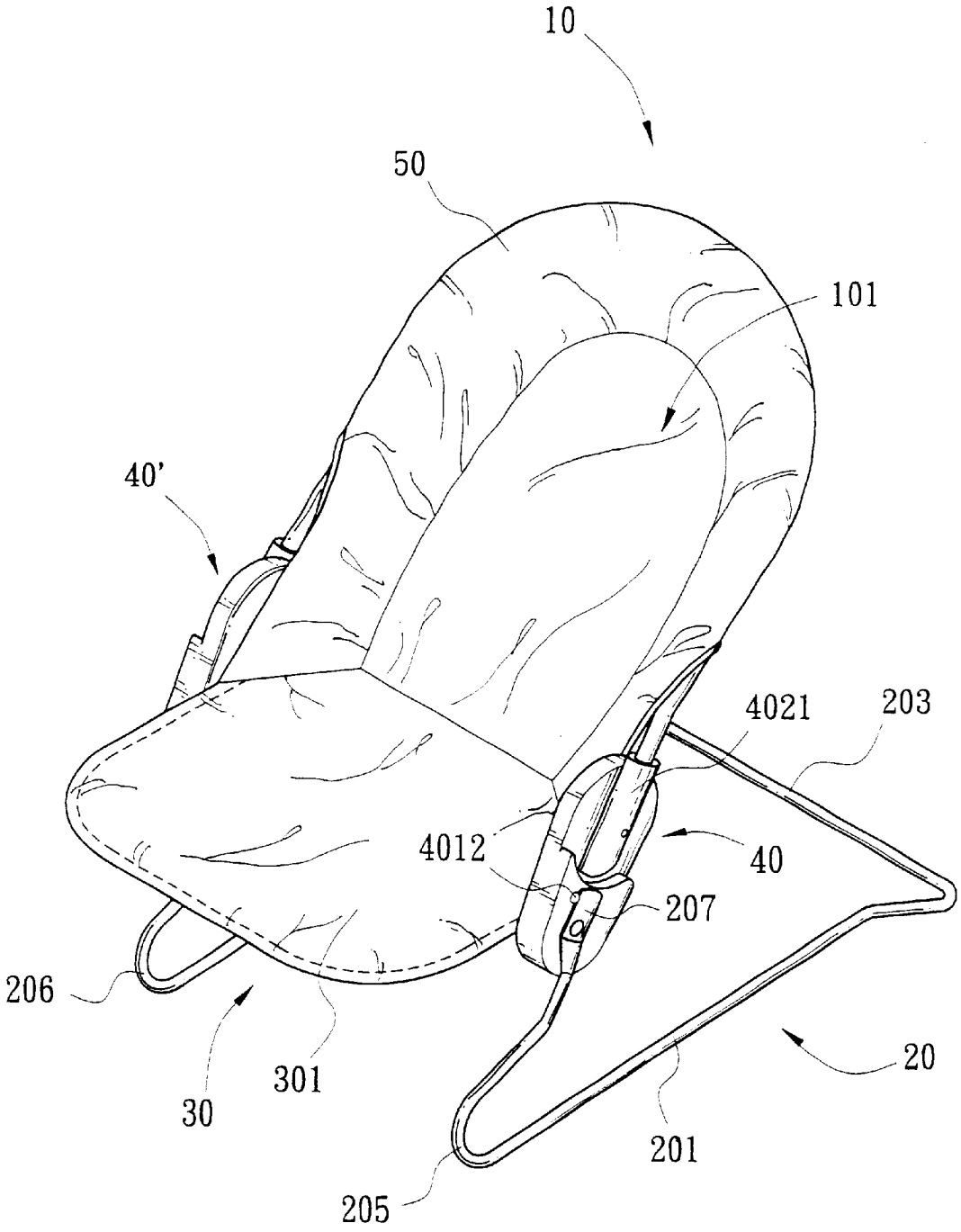
FIG. 2 is a perspective view of the assembled FIG. 1 rocking chair.
Figure 3:
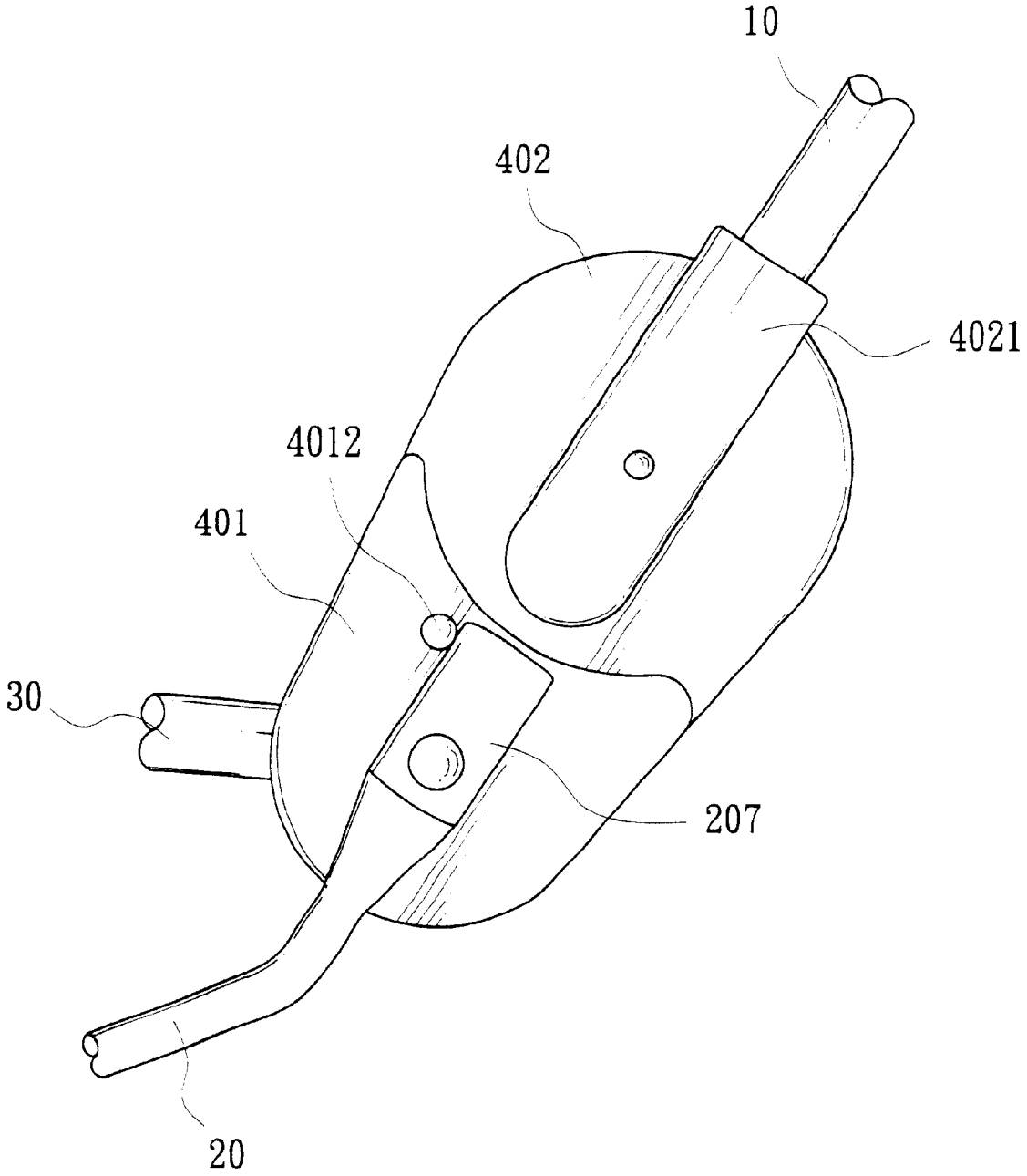
FIG. 3 is a side view of latch of FIG. 1.

Referring to FIGS. 1, 2, and 3, there is shown a collapsible rocking chair constructed in accordance with the invention comprising an upper frame 10, a lower frame 20, a seat frame 30 and a pair of latches 40, 40'.

Upper frame 10 is generally a U-shaped metal tube having two ends 102, 103 and forms a backrest 101 covered by a fabric pad 50. Lower frame 20 is generally a U-shaped metal tube comprising two opposite bars 201, 202 and a cross bar 203 connected one end of the two opposite bars 201, 202 for sustaining on the ground. Two curved flexible portions 205, 206 are extended from another end of the opposite bars 201, 202. Two attachment members 207, 208 are extended from the flexible portions 205, 206. Seat frame 30 is also generally a U-shaped metal tube having two ends 302, 303 and forms a seat portion 301 covered by a fabric pad 50.

Note that latch 40' is a mirror image of latch 40. Thus, only latch 40 is described below for the sake of brevity.

Figure 4A:
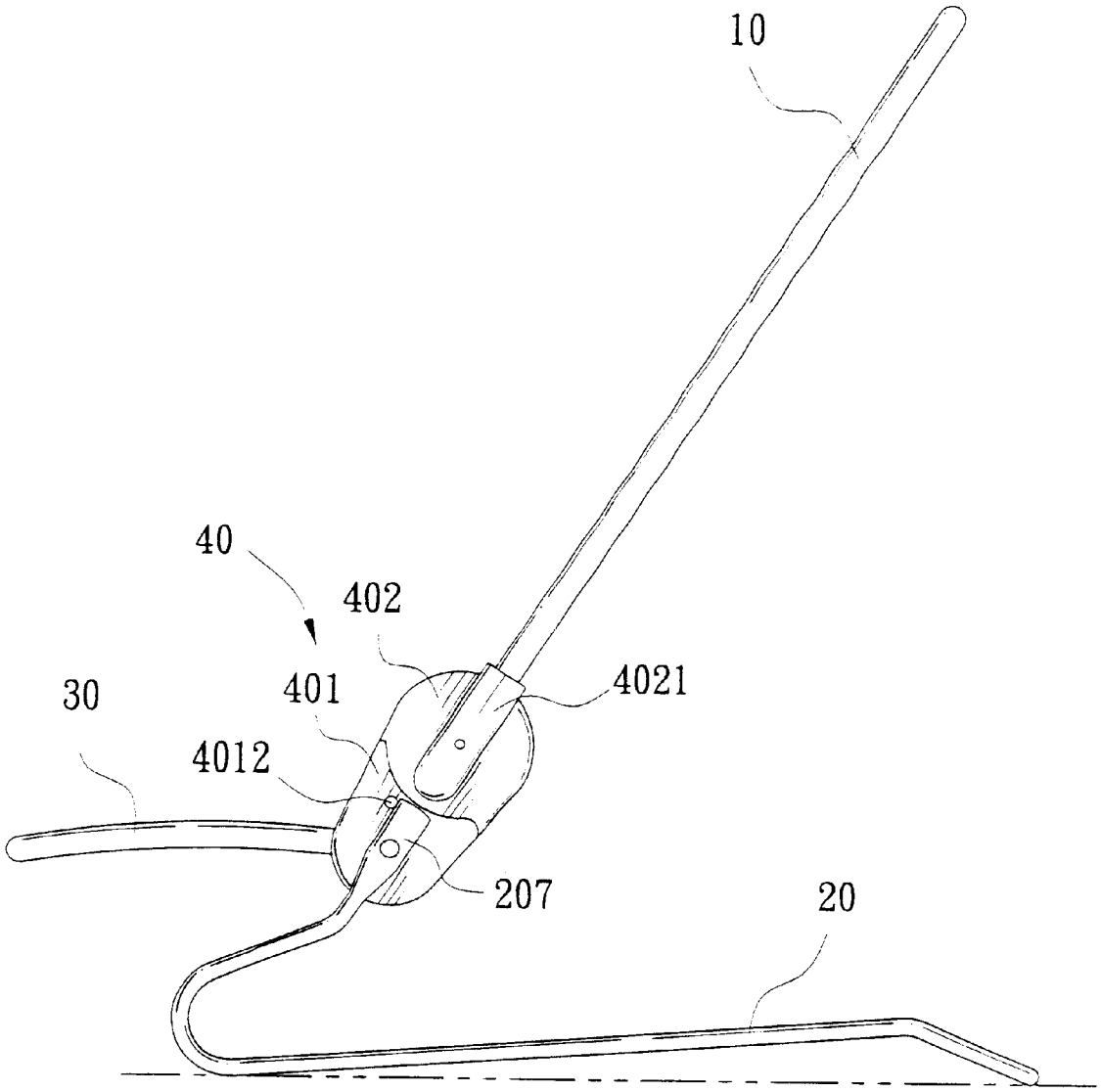
FIG. 4A is a side view of the FIG. 1 rocking chair in an unfolded position.

Referring to FIG. 3 specifically, latch 40 comprises a first connection portion 401 having a hole 4011 and a second connection portion 402 having a tube member 4021. A positioning member 4012 on the outer surface adjacent the hole 4011 whose two sides formed the two fixed positions and a stopping member 4013 on the inner surface. Referring to FIG. 2 specifically, the attachment member 207 pivotally connects to the hole 4011 of the latches 40 by a pin 60. The pin 60 inserts through the latch 40 to pivotally mount the seat frame 30 on reverse side of the first connection portion 401. The two ends 102. 103 of upper frame 10 inserts to the tube member 4021 of the second connection portion 402. Such that rocking chair is configured to allow a child to sit or lie thereon. Also, lower frame 20 keeps an angle or a distance to upper frame 10 by the flexible portions 205, 206. The attachment member 207 is against the positioning member 4012 in the first fixed position and seat frame 30 is against the stopping member 4013. As a result, referring to FIG. 4A the seated or recumbent child may rock up and down a little about the flexible portions 205, 206.

Figure 4B:
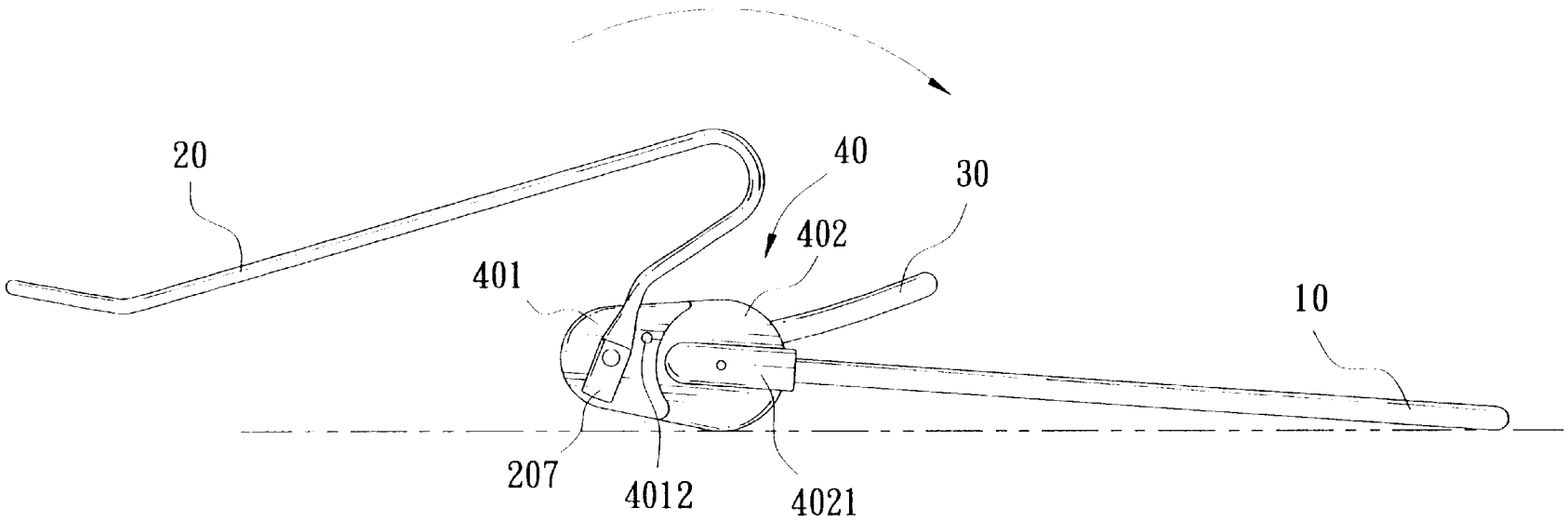
FIG. 4B is similar to FIG. 4A wherein the FIG. 1 rocking chair is partially collapsed.
Figure 4C:
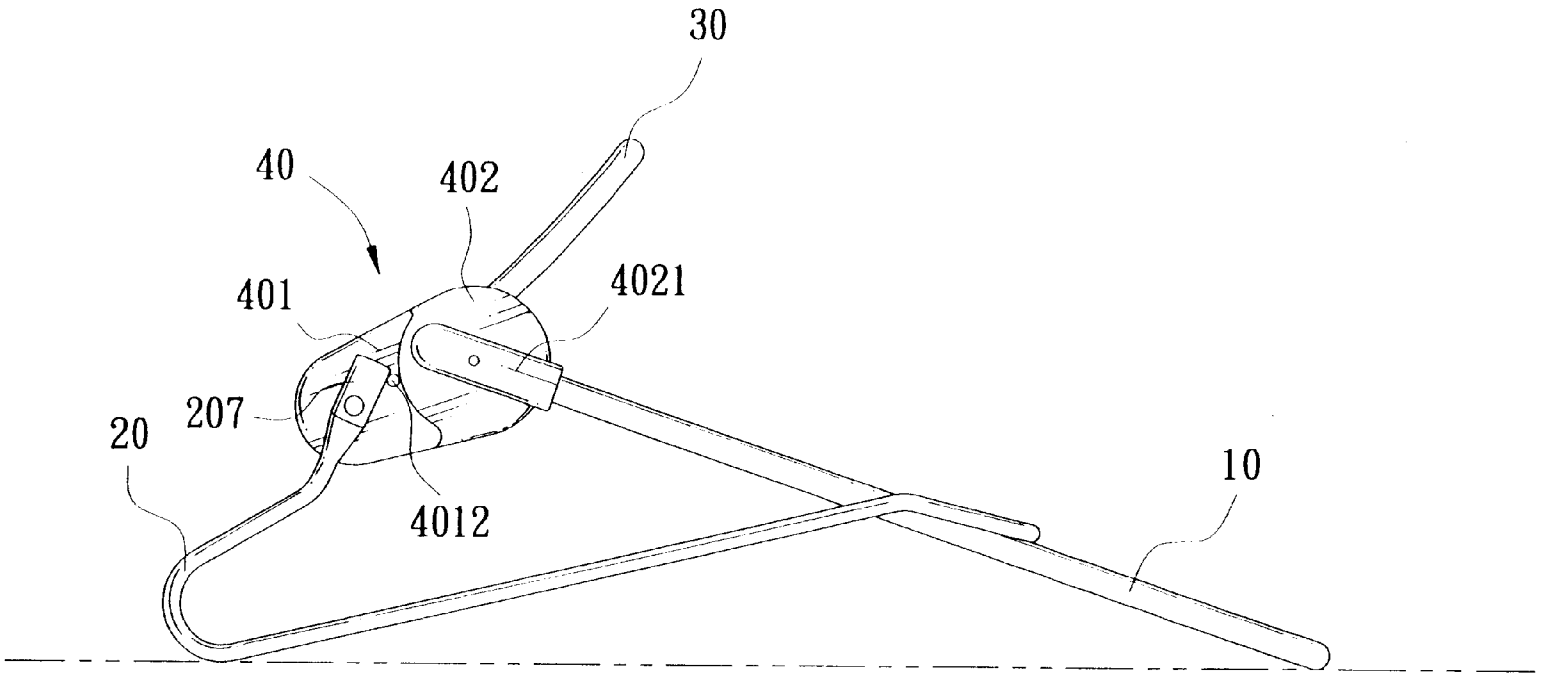
FIG. 4C is similar to FIG. 4A wherein the FIG. 1 rocking chair is collapsed.

Referring to FIG. 4B, in collapsing the rocking chair, first fold seat frame 30 toward upper frame 10 with respect to latches 40. Then fold lower frame 20 toward upper frame 10 with respect to pins 60 until the attachment members 207 is against positioning members 4012 in a second fixed position. Referring to FIG. 4C, finally fold seat frame 30 and lower frame 20 toward upper frame 10, thus forming a compact rocking chair for facilitating storage.

Figure 5:
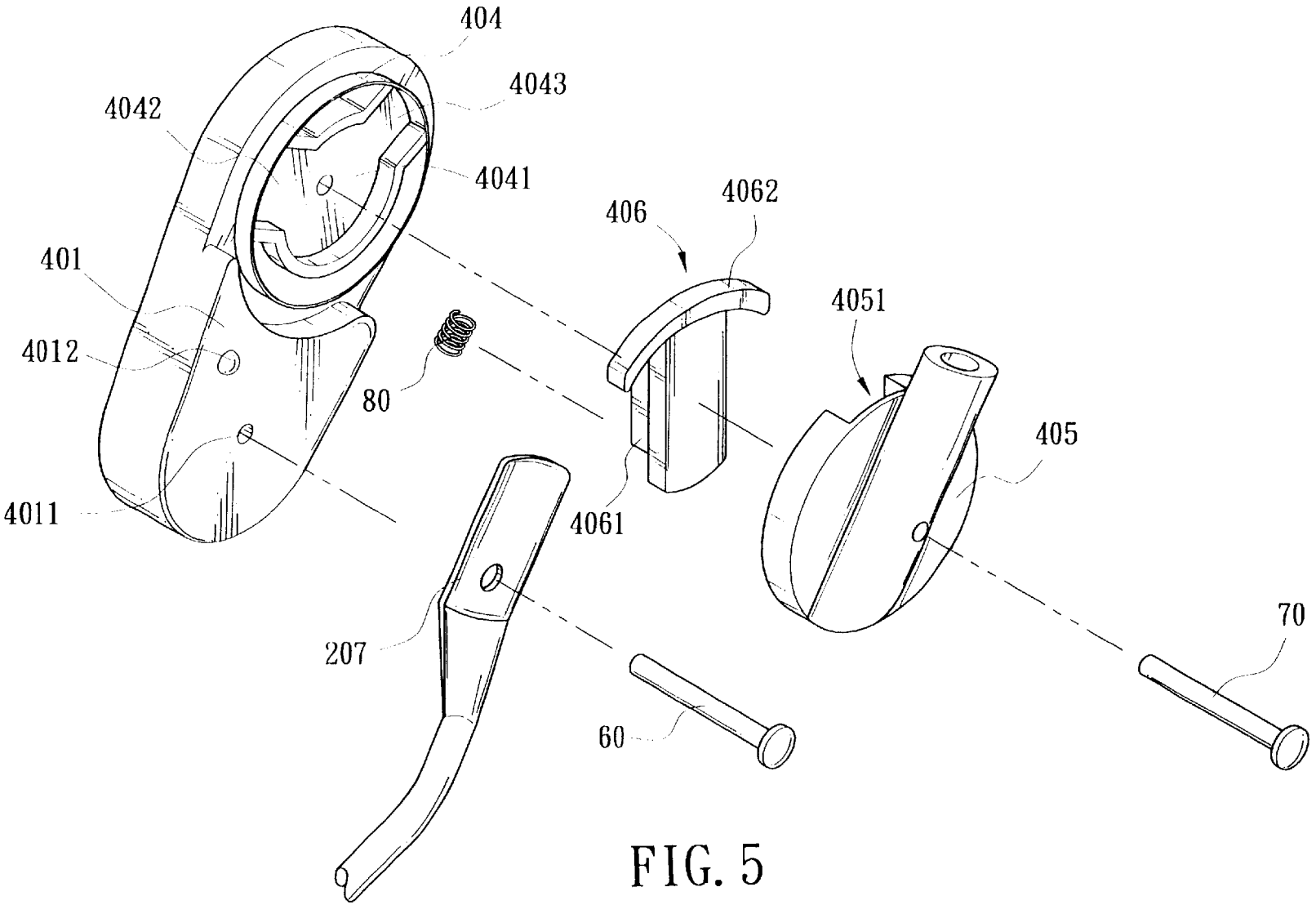
FIG. 5 is an exploded view of a latch of collapsible rocking chair of a second preferred embodiment according to the invention.

It is found that upper frame 10 is not moved during collapsing since it is inserted in tube member 4021 and in a fixed relationship with respect to the latch 40. As such, rocking chair is not collapsed to its minimum storage space. Accordingly, this second embodiment is provided as a modification of the first one aimed at changing the position of upper frame 10 during collapsing so as to fold the rocking chair in its minimum storage space when not in use. Referring, to FIG. 5, there is shown a latch 40 of collapsible rocking chair of a second preferred embodiment according to the invention.

A pivot base 404, a cover 405, and a press button 406 are provided on latch 40. Pin 70 is inserted through tube member 4021, cover 405, press button 406, and pivot base 404. As such, cover 405 is pivot with respect to pivot base 404 about pin 70. Press button 406 comprises a press member 4062 and a positioning member 4061. Pivot base 404 has a center recess 4041 and two positioning channels 4042, 4043 each communicating between the recess 4041 and the periphery of pivot base 404. Cover 405 has an opening 4051. In a configuration, positioning member 4061 is inserted into opening 4051 and positioning channel 4042 to reach recess 4041, while press member 4062 is on the outside of opening 4051. Also, spring 80 is anchored in positioning member 4061 for providing an elastic movement of the positioning member 4061 when it is activated.

Figure 6A:
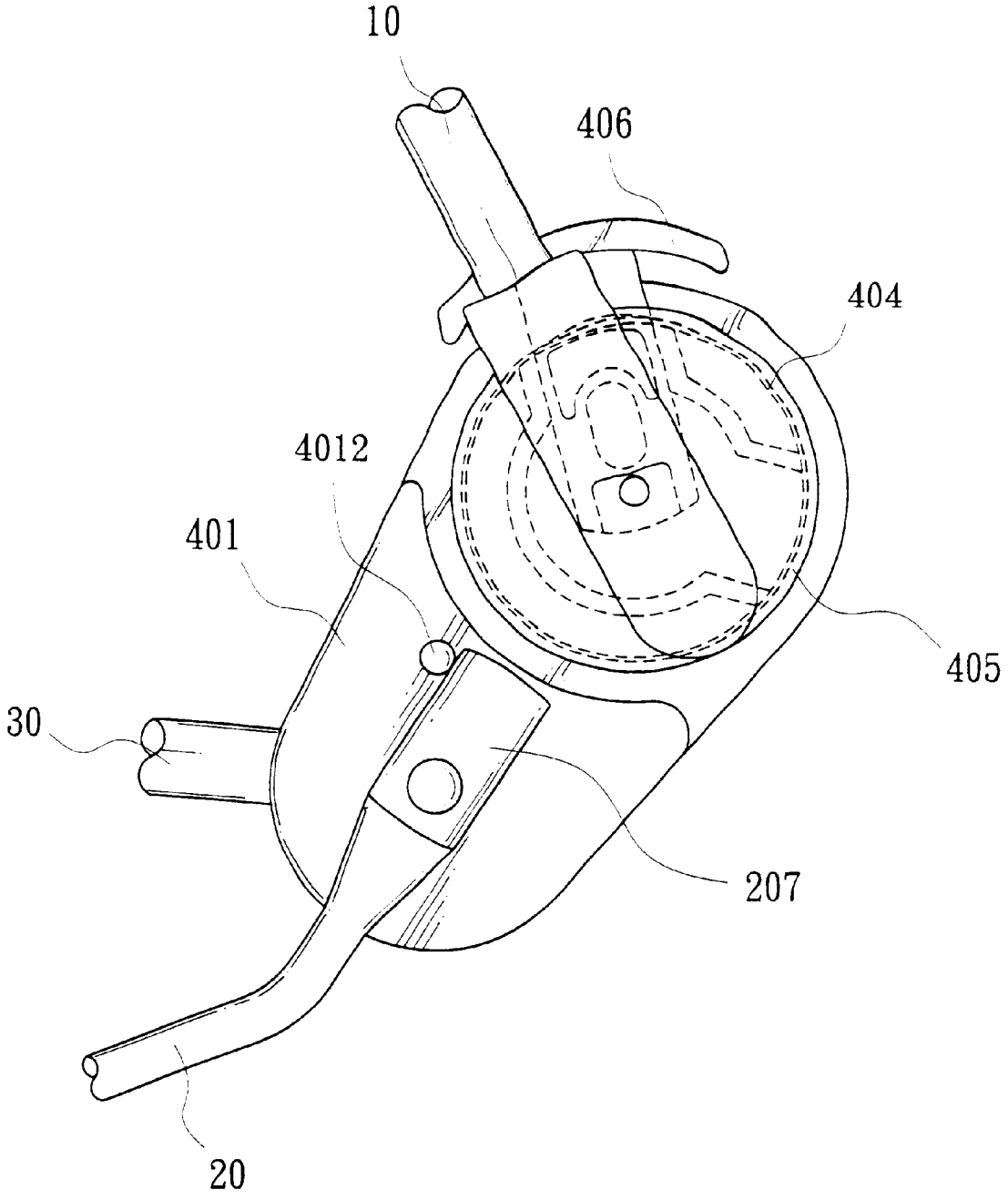
FIG. 6A is a side view of the assembled FIG. 5 latch in an unfolded locked position of rocking chair.
Figure 6B:
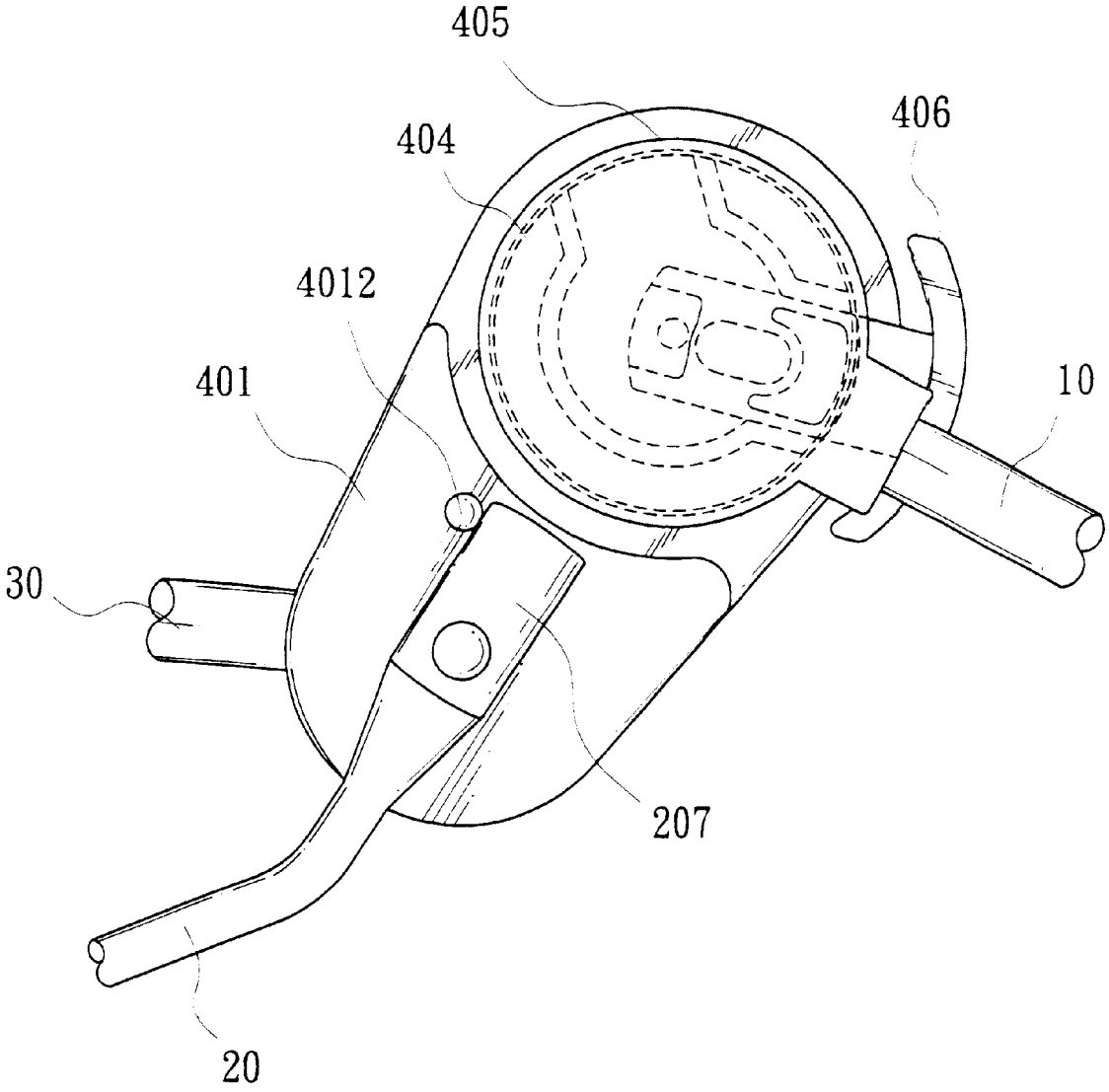
FIG. 6B is similar to FIG. 6A wherein the FIG. 5 latch has shifted to a second position for enabling to collapse the rocking chair.
Figure 7:
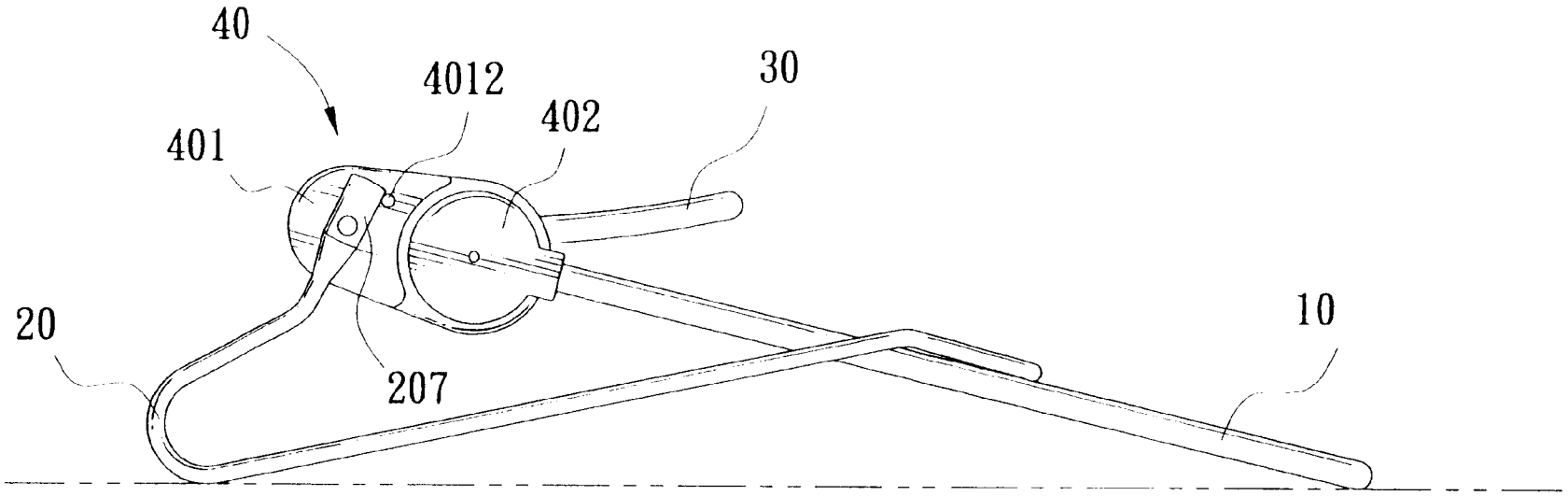
FIG. 7 is side view of the collapsed FIG. 5 rocking chair.

Referring to FIGS. 6A, 6B, and 7, the collapsing operation of the FIG. 5 rocking chair is now described. First, press down the press member 4062 to cause positioning member 4061 to clear positioning channel 4042 (i.e., first position) as shown in FIG. 6A. Then rotate the press member 4062 to alien with the other positioning channel 4043. At the same time, release the press member 4062 to cause positioning member 4061 to move upward into the other positioning channel 4043. Thus, cover 405 is secured in this second position as shown in FIG. 6B. As a result, upper frame 10 is moveable between first and second positions. Finally, perform a collapsing operation the same as that described above in the first embodiment. Thus, a collapsed rocking chair is obtained. As shown in FIG. 7, upper frame 10 is aligned with latch 40 as compared to the acute angle formed between upper frame 10 and latch 40 in FIG. 4C. As an end, the rocking chair is collapsed to a more compact storage position.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A collapsible rocking chair comprising:

an upper frame having a backrest portion and two ends;

a pair of latches each including a first connection portion defining at least two stop positions and a second connection portion connected to a respective end of the upper frame;

a lower frame comprising two opposite bars and a cross bar connecting one end of the two opposite bars for resting on the ground, two flexible portions attached to another end of the opposite bars for keeping an angle or a distance with the upper frame, and two attachment members extended from the flexible portions which are pivotally engaged to the first connection portion stop positions and movable between the two for keeping the upper frame and the lower frame in an unfolded position or a folded position; and a seat frame having a seat portion and two ends connected to the latches.

2. The collapsible rocking chair of claim 1, wherein the first connection portion of each latch comprises a positioning member whose two sides formed the two stop positions for positioning the attachment members.

3. The collapsible rocking chair of claim 1, wherein the second connection portion of each latch comprises a tube member for receiving the upper frame.

4. The collapsible rocking chair of claim 1, wherein each flexible portion of the lower frame is curved.

5. A collapsible rocking chair comprising:

an upper frame having a backrest portion and two ends;

a pair of latches each including a second connection portion connected to a respective end of the upper frame and a first connection portion, both of them defining at least two stop positions;

a lower frame comprising two opposite bars and a cross bar connecting one end of the two opposite bars for resting on the ground, two flexible portions attached to another end of the opposite bars for keeping an angle or a distance with the upper frame, and two attachment members extended from the flexible portions which are pivotally engages to the first connection portion and movable between the two for stop positions keeping the upper frame and the lower frame in an unfolded position or a folded position; and a seat frame having a seat portion and two ends connected to the latches;

wherein the stop positions in the second portion further allow the upper frame to collapse respective to the seat frame.

6. The collapsible rocking chair of claim 5, wherein the second connection portion of each latch comprises a pivot base and a cover pivotally mounted in the pivot base.

7. The collapsible rocking chair of claim 6, wherein the second connection portion further comprising a press button between the pivot base and the cover.

8. The collapsible rocking chair of claim 6, wherein the pivot base comprises a center recess having two positioning channels.

9. The collapsible rocking chair of claim 6, wherein the press button comprises a press member and a positioning member movable in the recess and inserted into the positioning channel.

10. The collapsible rocking chair of claim 6, wherein the pivot base comprises a tube member for receiving the upper frame.

11. The collapsible rocking chair of claim 6, wherein the first connection portion of each latch comprises a positioning member whose two sides formed the two fixed positions for positioning the attachment members.

12. A collapsible rocking chair comprising:

an upper frame having a backrest portion and two ends;

a pair of latches each including a first connection portion having a positioning member to provide at least two stop positions and a second connection portion connected to a respective end of the upper frame;

a lower frame comprising two opposite bars and a cross bar connected one end of the two opposite bars for resting on the ground, two flexible portions attached to another end of the opposite bars for keeping an angle or a distance with the upper frame, and two attachment members extended from the flexible portions which are pivotally engaged to the first connection portion; and a seat frame having a seat portion and two ends connected to the latches;

wherein the attachment members are structured to stop at two generally opposite points of the positioning member, the opposite points serving as the stop positions to allow the upper frame and the lower frame to be in either an unfolded position or a folded position.

13. The collapsible rocking chair of claim 12, wherein the second connection portion comprises a pivot base, a cover pivotally mounted in the pivot base for receiving one end of the upper frame, and a press button engaged with the cover; the pivot base comprises a recess having two positioning channels, said two positioning channels serving as the stop positions of the second connection portion for the press button to thus allow the upper frame to collapse respective to the seat frame.

* * * * *